US006959539B2

(12) United States Patent
Rösel et al.

(10) Patent No.: US 6,959,539 B2
(45) Date of Patent: Nov. 1, 2005

(54) EXHAUST-GAS CLEANING SYSTEM FOR AN INTERNAL-COMBUSTION ENGINE

(75) Inventors: Gerd Rösel, Regensburg (DE); Hong Zhang, Tegernheim (DE)

(73) Assignee: Siemens Aktiengesellschaft, Munich (DE)

( * ) Notice: Subject to any disclaimer, the term of this patent is extended or adjusted under 35 U.S.C. 154(b) by 654 days.

(21) Appl. No.: 10/040,116

(22) Filed: Jan. 2, 2002

(65) Prior Publication Data

US 2002/0102190 A1 Aug. 1, 2002

(30) Foreign Application Priority Data

Jul. 9, 2001 (DE) ..... 101 00 613

(51) Int. Cl.[7] ..... F01N 3/00

(52) U.S. Cl. ..... 60/276; 60/284; 60/285; 701/103; 701/109

(58) Field of Search ..... 60/274, 276, 284, 60/285; 701/103, 109

(56) References Cited

U.S. PATENT DOCUMENTS 5,319,921 A * 6/1994 Gopp ..... 60/274
5,383,333 A 1/1995 Logothetis et al.
5,647,205 A 7/1997 Wier et al.
5,842,340 A * 12/1998 Bush et al. ..... 60/274
6,116,021 A * 9/2000 Schumacher et al. ..... 60/274
6,256,983 B1 * 7/2001 Yasui ..... 60/285
6,321,529 B1 11/2001 Mueller et al.
6,374,597 B1 * 4/2002 Bidner et al. ..... 60/285
6,449,944 B1 * 9/2002 Yasui et al. ..... 60/277
6,550,307 B1 4/2003 Zhang et al.

FOREIGN PATENT DOCUMENTS

DE 35 00 594 C2 7/1986
DE 43 08 894 A1 9/1994
DE 44 33 464 C2 4/1995
DE 198 52 294 A1 5/2000
DE 198 56 367 C1 6/2000

* cited by examiner

*Primary Examiner*—Binh Q. Tran
(74) *Attorney, Agent, or Firm*—Laurence A. Greenberg; Werner H. Stemer; Ralph E. Locher

(57) ABSTRACT

An exhaust-gas cleaning system for an internal-combustion engine has an exhaust-gas cleaning element, a first exhaust-gas sensor located upstream from the exhaust-gas cleaning element, and a control unit with an input connected to a first exhaust-gas sensor. The output of the control unit is connected to an engine management system for controlling the composition of the mixture in the internal-combustion engine as a function of the exhaust-gas composition that is measured by the first exhaust-gas sensor. A second exhaust-gas sensor has an output connected to the control unit. The second exhaust-gas sensor is arranged in the exhaust-gas stream of the internal-combustion engine, and is arranged downstream of the exhaust-gas cleaning element. The second gas sensor enables the control unit to cause a modification of the local balance of the oxygen concentration in the exhaust-gas cleaning element.

14 Claims, 2 Drawing Sheets

EXHAUST-GAS CLEANING SYSTEM FOR AN INTERNAL-COMBUSTION ENGINE

BACKGROUND OF THE INVENTION

Field of the Invention

The invention relates to an exhaust-gas cleaning installation for an internal-combustion engine.

In passenger cars with an internal-combustion engine, a catalytic converter is usually employed to clean the exhaust-gas stream. To achieve an optimum cleaning action, the oxygen concentration in the catalytic converter must lie within a predetermined range. This is important, since the pollutants HC, CO and $NO_x$ are optimally converted in the catalytic converter only at the predetermined oxygen concentration. The desired composition of the mixture in the internal-combustion engine is set by the electronic engine management system, which suitably defines, for example, the duration of injection, the time of injection, or the throttle valve position.

It is also known to control the composition of the mixture in the internal-combustion engine as a function of the exhaust-gas composition of the internal-combustion engine so that the optimum oxygen concentration is restored in the catalytic converter as quickly as possible after a fault, for example, after a temporary overrun cutoff. For this purpose, a lambda sensor is provided to measure the exhaust-gas composition. The output of the lambda sensor is connected, via a control unit with at least one double I component, to the electronic engine management system. The lambda sensor is arranged in the exhaust-gas stream between the internal-combustion engine and the catalytic converter. The double I component of the control unit advantageously enables the oxygen concentration in the catalytic converter to be restored after faults that do not exceed the ability of the catalytic converter to store oxygen. The result, therefore, is local balancing of the oxygen concentration in the catalytic converter. The control sequence has the purpose of keeping the oxygen concentration in the catalytic converter within a predetermined range.

If the change in the oxygen concentration that is caused by the fault exceeds the storage capacity of the catalytic converter, however, errors occur when the control means compensates for the fault. These errors lead to additional emissions on top of the emissions caused by the fault. These additional emissions are caused by incorrect local balancing as a result of overcompensation. In the known exhaust-gas cleaning system for an internal-combustion engine as described above, relatively major faults are incorrectly compensated for by control operations. This results in undesirable additional emissions, which is a drawback.

SUMMARY OF THE INVENTION

It is accordingly an object of the invention to provide an exhaust-gas cleaning system for an internal-combustion engine which overcomes the above-mentioned disadvantages of the prior art apparatus of this general type.

It is an additional object of the invention to improve the control response for the oxygen concentration of the catalytic converter in such that control means can cleanly compensate for even relatively major faults.

With the foregoing and other objects in view there is provided, in accordance with the invention, an exhaust-gas cleaning system for an internal-combustion engine. The exhaust-gas cleaning system includes: an engine management system for setting the composition of the mixture in the internal-combustion engine; and a first exhaust-gas sensor for measuring a composition of the exhaust-gas stream of the internal-combustion engine. The first exhaust-gas sensor is configured in the exhaust-gas stream of the internal-combustion engine. The exhaust-gas cleaning system includes a first exhaust-gas cleaning element configured in the exhaust-gas stream of the internal-combustion engine. The first exhaust-gas cleaning element is configured downstream from the first exhaust-gas sensor. The exhaust-gas cleaning system includes a control unit for controlling the composition of the mixture in the internal-combustion engine as a function of the composition of the exhaust-gas stream measured by the first exhaust-gas sensor. The control unit has an input connected to the first exhaust-gas sensor, and the control unit has an output connected to the engine management system. The exhaust-gas cleaning system includes a second exhaust-gas sensor configured in the exhaust-gas stream of the internal-combustion engine. The second exhaust-gas sensor is configured downstream from the first exhaust-gas cleaning element. The control unit has a control response and a control input for influencing the control response to modify the local balance of the oxygen concentration in the first exhaust-gas cleaning element. The control input of the control unit is connected to the second exhaust-gas sensor.

In accordance with an added feature of the invention, the second exhaust-gas sensor measures the exhaust-gas composition of the exhaust-gas stream of the internal-combustion engine; the control unit has two I-controllers connected in series, each one of the two I-controllers has a control response; and the second exhaust-gas sensor is connected to one of the two I-controllers to influence the control response of the one of the two I-controllers as a function of the exhaust-gas composition measured by the second exhaust-gas sensor.

In accordance with an additional feature of the invention, a second exhaust-gas cleaning element is configured in the exhaust-gas stream of the internal-combustion engine. The second exhaust-gas cleaning element is configured downstream from the second exhaust-gas sensor.

In accordance with another feature of the invention, the first exhaust-gas cleaning element includes a catalytic converter, and/or the second exhaust-gas cleaning element includes a catalytic converter.

In accordance with a further feature of the invention, the first exhaust-gas sensor is a lambda sensor, and/or the second exhaust-gas sensor is a lambda sensor.

In accordance with a further added feature of the invention, the first exhaust-gas sensor is a binary lambda sensor, and/or the second exhaust-gas sensor is a binary lambda sensor.

In accordance with a concomitant feature of the invention, the control unit includes a controller selected from the group consisting of a P-controller, an I-controller, a D-controller, and/or an $I^2$-controller.

The invention utilizes the general technical teaching of providing two independent control circuits for controlling the oxygen concentration in the catalytic converter. The first control circuit preferably has at least two I-controllers that are arranged in series, whereas the second control circuit preferably influences the control response and/or the trim of the first I-controller to avoid overcompensation in the event of a major fault. The second control circuit preferably receives the output signal from an exhaust-gas sensor as an input variable. The exhaust-gas sensor is arranged in the exhaust-gas stream of the internal-combustion engine and is arranged downstream from the catalytic converter. The exhaust-gas sensor is preferably designed as a binary lambda sensor.

Other features which are considered as characteristic for the invention are set forth in the appended claims.

Although the invention is illustrated and described herein as embodied in exhaust-gas cleaning system for an internal-combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
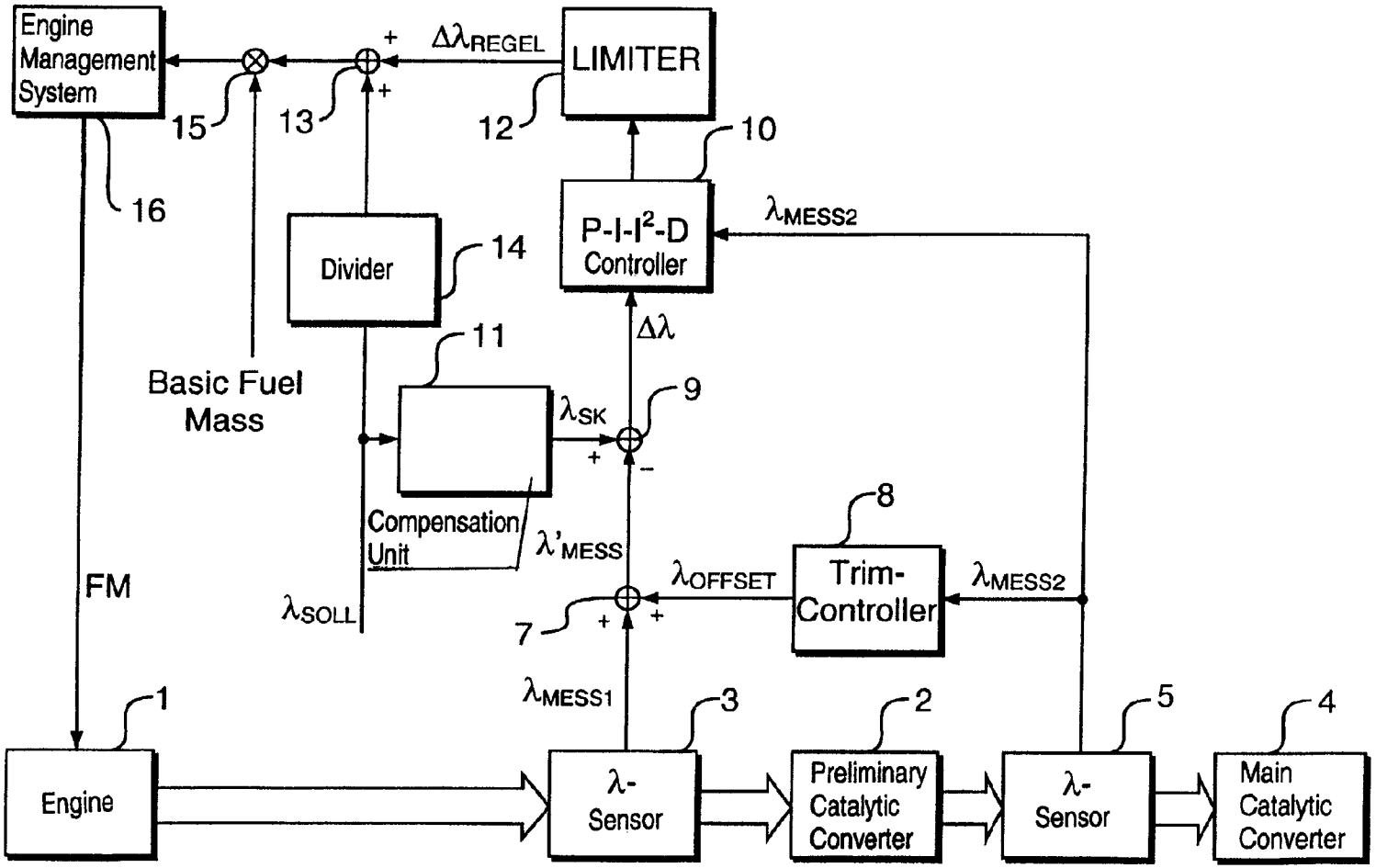
FIG. 1 is a circuit diagram of an exhaust-gas cleaning system.

Referring now to the figures of the drawing in detail and first, particularly, to FIG. 1 thereof, there is shown an exhaust-gas cleaning system that allows the exhaust-gas stream from an internal-combustion engine 1 to be cleaned. For this purpose, a preliminary catalytic converter 2 is arranged in the exhaust-gas stream of the internal-combustion engine 1. A lambda sensor 3 measures the composition of the exhaust-gas stream upstream of the preliminary catalytic converter 2 and emits a corresponding output signal $\lambda_{MESS1}$. The lambda sensor 3 is arranged between the internal-combustion engine 1 and the preliminary catalytic converter 2. The output of the preliminary catalytic converter 2 is connected to a main catalytic converter 4 that performs a complete cleaning of the exhaust-gas stream. A second lambda sensor 5 measures the composition of the exhaust-gas stream upstream of the main catalytic converter 4 and emits a corresponding output signal $\lambda_{MESS2}$. The second lambda sensor 5 is arranged between the preliminary catalytic converter 2 and the main catalytic converter 4. The second lambda sensor 5 is a binary lambda sensor that, in the event of a lean/rich transition of the exhaust-gas composition, emits a corresponding signal.

To optimally convert the pollutants HC, CO and $NO_x$ that are contained in the exhaust-gas stream in the preliminary catalytic converter 2 and in the main catalytic converter 4, it is important to maintain a predetermined oxygen concentration in the preliminary catalytic converter 2 as well as the main catalytic converter 4. It is possible for the oxygen concentration to fluctuate within a small range without the cleaning action deteriorating significantly. Two control circuits, which are independent of one another and which are described below, are provided to set the desired oxygen concentration in the preliminary catalytic converter 2 and in the main catalytic converter 4.

The first control circuit has an input connected to the lambda sensor 3 and thereby captures the exhaust-gas composition upstream of the preliminary catalytic converter 2. The output of the lambda sensor 3 is connected to an adder 7 that adds an offset value $\lambda_{OFFSET}$ to the measured value $\lambda_{MESS1}$. This offset value is calculated by a control unit 8 as a function of the output signal $\lambda_{MESS2}$ from the binary lambda sensor 5.

The output of the adder 7 is connected to a subtractor 9, which calculates the control deviation $\Delta\lambda$ to actuate a control unit 10. For this purpose, the exhaust-gas cleaning system receives a stipulated desired value $\lambda_{SOLL}$ for the exhaust-gas composition upstream of the preliminary catalytic converter 2. The desired value $\lambda_{SOLL}$ is fed to a compensation unit 11 that compensates for the measurement performance of the lambda sensor 3 and the signal delay times and generates a compensated desired value $\lambda_{SK}$. The compensated desired value $\lambda_{SK}$ is fed to the subtractor 9.

Furthermore, the control unit 10, as part of a second control circuit, is connected to the lambda sensor 5 to be able to change the control response in the event of a breakthrough at the preliminary catalytic converter 2, i.e. in situations when the exhaust-gas composition changes downstream of the preliminary catalytic converter 2.

The control unit 10 determines a control signal $\Delta\lambda_{REGEL}$ as a function of the control deviation $\Delta\lambda$. The control signal $\Delta\lambda_{REGEL}$ is fed through a limiter 12 to an adder 13. The predetermined desired value $\lambda_{SOLL}$ for the exhaust-gas composition is processed by a divider 14 and is then captured by the other input of the adder 13.

The output of the adder 13 is connected to a multiplier 15. The multiplier 15 forms the product of a basic fuel mass and the output signal from the adder 13 and transmits this product to an engine management system 16. The engine management system 16 then sets the composition of the mixture in the internal-combustion engine 1 accordingly.

Figure 2:
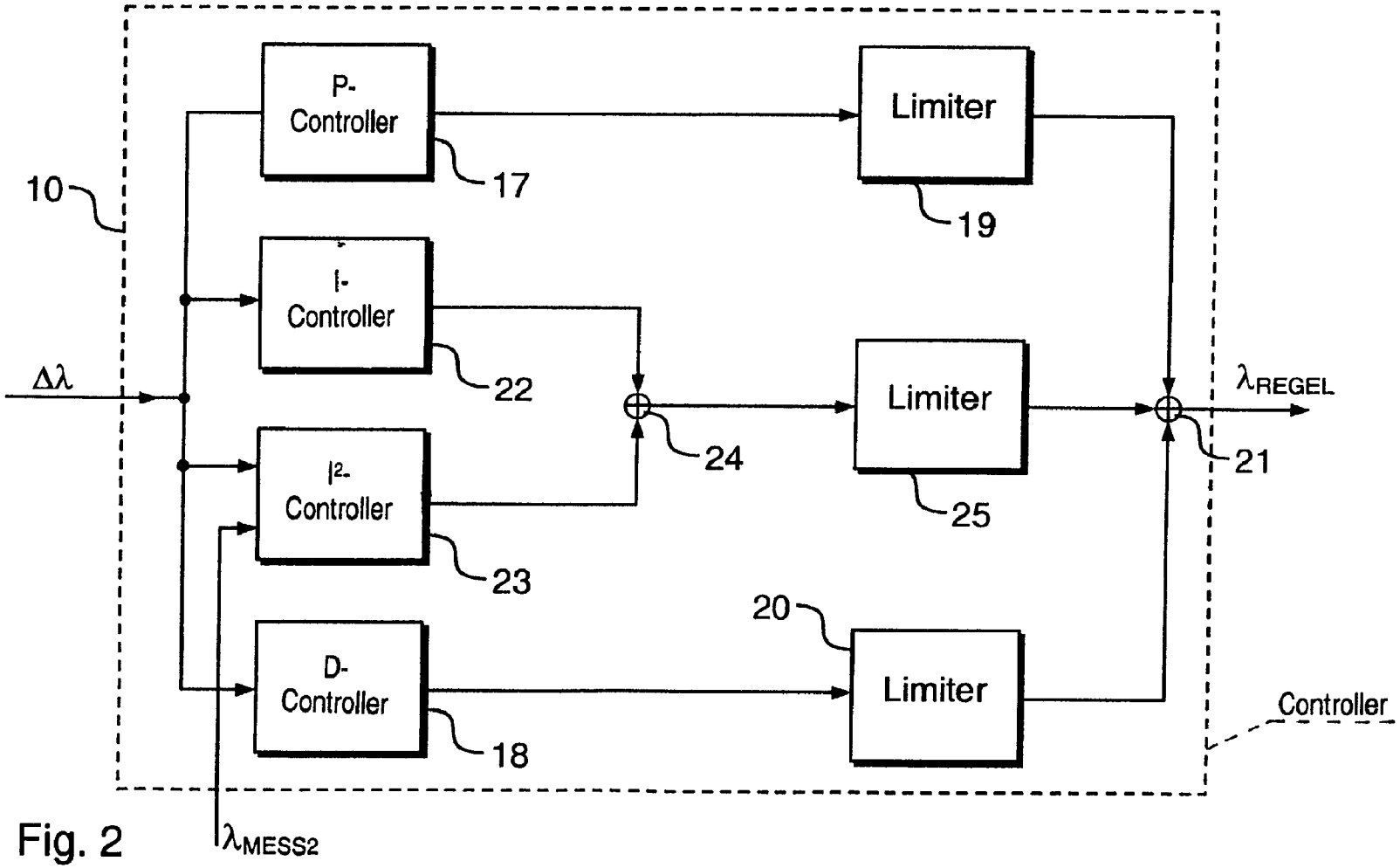
FIG. 2 is a circuit diagram of the control unit of the exhaust-gas cleaning system shown in FIG. 1.

The structure of the control unit 10 will now be described below with reference to FIG. 2.

The control unit 10 has a P-controller 17 and a D-controller 18, which each have an input acquiring the control deviation $\Delta\lambda$. The output of the P-controller 17 and the output of the D-controller are connected to an adder 21 by a respective limiter 19, 20.

In addition, the control unit 10 has an I-controller 22 and an $I^2$-controller 23, which each have an input acquiring the control deviation $\Delta\lambda$. The output of the I-controller 22 and the output of the $I^2$-controller 23 are connected to the adder 21 via an adder 24 and a limiter 25.

Furthermore, the $I^2$-controller 23 is connected to the lambda sensor 5 and changes its control response as a function of the output signal $\lambda_{MESS2}$ from the lambda sensor 5. The control response changes as a result of the proportional reduction of the functional value of the first integrator of the $I^2$-controller 23 if the lambda sensor 5 signals a breakthrough at the preliminary catalytic converter 2. As a result, the local balancing operation is modified in such a manner that the oxygen storage capacity of the preliminary catalytic converter is taken into account.

The invention is not restricted to the exemplary embodiment described above. Rather, a wide range of variants and modifications can be conceived which utilize the inventive idea and are likewise covered by the scope of protection.

We claim:

1. An exhaust-gas cleaning system for an internal-combustion engine having an exhaust-gas stream, comprising:

an engine management system for setting a composition of a mixture in the internal-combustion engine;

a first exhaust-gas sensor for measuring a composition of the exhaust-gas stream of the internal-combustion engine, said first exhaust-gas sensor configured in the exhaust-gas stream of the internal-combustion engine;

a first exhaust-gas cleaning element configured in the exhaust-gas stream of the internal-combustion engine, said first exhaust-gas cleaning element configured downstream from said first exhaust-gas sensor;

a control unit for controlling the composition of the mixture in the internal-combustion engine as a function of the composition of the exhaust-gas stream measured by said first exhaust-gas sensor, said control unit having an input connected to said first exhaust-gas sensor, said control unit having an output connected to said engine management system, and said control unit having two I-controllers connected in series, each one of said two I-controllers having a control response; and a second exhaust-gas sensor configured in the exhaust-gas stream of the internal-combustion engine, said second exhaust-gas sensor configured downstream from said first exhaust-gas cleaning element, said second exhaust-gas sensor measuring the exhaust-gas composition of the exhaust-gas stream of the internal-combustion engine, and said second exhaust-gas sensor being connected to one of said two I-controllers to influence the control response of said one of said two I-controllers as a function of the exhaust-gas composition measured by said second exhaust-gas sensor;

said control unit having a control response and a control input for influencing the control response to modify a local balance of an oxygen concentration in said first exhaust-gas cleaning element; and said control input of said control unit being connected to said second exhaust-gas sensor.

2. The exhaust-gas cleaning system according to claim 1, comprising:

a second exhaust-gas cleaning element configured in the exhaust-gas stream of the internal-combustion engine, said second exhaust-gas cleaning element configured downstream from said second exhaust-gas sensor.

3. The exhaust-gas cleaning system according to claim 2, wherein said second exhaust-gas cleaning element includes a catalytic converter.

4. The exhaust-gas cleaning system according to claim 3, wherein said first exhaust-gas cleaning element includes a catalytic converter.

5. The exhaust-gas cleaning system according to claim 1, wherein said first exhaust-gas cleaning element includes a catalytic converter.

6. The exhaust-gas cleaning system according to claim 1, wherein said first exhaust-gas sensor is a lambda sensor.

7. The exhaust-gas cleaning system according to claim 6, wherein said second exhaust-gas sensor is a lambda sensor.

8. The exhaust-gas cleaning system according to claim 1, wherein said second exhaust-gas sensor is a lambda sensor.

9. The exhaust-gas cleaning system according to claim 1, wherein said second exhaust-gas sensor is a binary lambda sensor.

10. The exhaust-gas cleaning system according to claim 9, wherein said second exhaust-gas sensor is a binary lambda sensor.

11. The exhaust-gas cleaning system according to claim 1, wherein said second exhaust-gas sensor is a binary lambda sensor.

12. The exhaust-gas cleaning system according to claim 1, wherein said control unit includes a controller selected from the group consisting of a P-controller, an I-controller, a D-controller, and an $I^2$-controller.

13. The exhaust-gas cleaning system according to claim 1, wherein said control unit includes a P-controller, an I-controller, a D-controller, and $I^2$-controller.

14. An exhaust-gas cleaning system for an internal-combustion engine having an exhaust-gas stream, comprising:

an engine management system for setting a composition of a mixture in the internal-combustion engine;

a first exhaust-gas sensor for measuring a composition of the exhaust-gas stream of the internal-combustion engine, said first exhaust-gas sensor configured in the exhaust-gas stream of the internal-combustion engine;

a first exhaust-gas cleaning element configured in the exhaust-gas stream of the internal-combustion engine, said first exhaust-gas cleaning element configured downstream from said first exhaust-gas sensor;

a control unit for controlling the composition of the mixture in the internal-combustion engine as a function of the composition of the exhaust-gas stream measured by said first exhaust-gas sensor, said control unit having an input connected to said first exhaust-gas sensor, said control unit having an output connected to said engine management system, and said control unit having two I-controllers connected in series, each one of said two I-controllers having a control response;

a second exhaust-gas sensor configured in the exhaust-gas stream of the internal-combustion engine, said second exhaust-gas sensor configured downstream from said first exhaust-gas cleaning element, said second exhaust-gas sensor measuring the exhaust-gas composition of the exhaust-gas stream of the internal-combustion engine, and said second exhaust-gas sensor being connected to one of said two I-controllers to influence the control response of said one of said two I-controllers as a function of the exhaust-gas composition measured by said second exhaust-gas sensor; and a second exhaust-gas cleaning element configured in the exhaust-gas stream of the internal-combustion engine, said second exhaust-gas cleaning element configured downstream from said second exhaust-gas sensor;

said control unit having a control response and a control input for influencing the control response to modify a local balance of an oxygen concentration in said first exhaust-gas cleaning element; and said control input of said control unit being connected to said second exhaust-gas sensor.

* * * * *